US005348459A

United States Patent [19]

Sauron et al.

[11] Patent Number: 5,348,459

[45] Date of Patent: Sep. 20, 1994

[54] PORTABLE DEVICE FOR STRAIGHTENING OUT TUBES

[75] Inventors: Jean Sauron, Draveil; Jean-Jacques Thomas, Paris, both of France

[73] Assignees: Societe Joseph Sauron Materiel Industriel; Gaz de France, France

[21] Appl. No.: 907,668

[22] Filed: Jul. 2, 1992

[30] Foreign Application Priority Data

Jul. 5, 1991 [FR] France ..... 91 08492

[51] Int. Cl.[5] ..... B21D 3/05; B29C 53/20

[52] U.S. Cl. ..... 425/11; 72/162; 72/164; 264/239; 264/280; 425/343; 425/367; 425/392

[58] Field of Search ..... 425/392, 363, 367, DIG. 7, 425/12, 343, 11; 72/162, 164, 165; 264/239, 280

[56] References Cited

U.S. PATENT DOCUMENTS

| | | | |
|---|---|---|---|
| 1,414,371 | 5/1922 | Nilson | 72/162 |
| 3,371,770 | 3/1968 | Graham et al. | 425/392 |
| 3,422,651 | 1/1969 | Urtel | 72/162 |
| 3,442,108 | 5/1969 | Muller | 72/164 |
| 3,492,850 | 2/1970 | Groppini | 72/162 |
| 4,334,418 | 6/1982 | Grandell | 72/164 |
| 4,719,781 | 1/1988 | Cloup | 72/164 |
| 5,092,756 | 3/1992 | Gau et al. | 425/367 |

FOREIGN PATENT DOCUMENTS

| | | |
|---|---|---|
| 529198 | 6/1931 | Fed. Rep. of Germany . |
| 456463 | 8/1913 | France . |
| 765707 | 1/1957 | United Kingdom . |
| 1553373 | 9/1979 | United Kingdom . |

*Primary Examiner*—Jay H. Woo
*Assistant Examiner*—Joseph Leyson
*Attorney, Agent, or Firm*—Steinberg, Raskin & Davidson

[57] ABSTRACT

A portable device for straightening out pipes including a hollow beam provided at its two ends with first and second movable bearing members, respectively, one of which or first movable bearing member is actuated by a jack housed within the hollow beam whereas a grip for handling the device is transversely and adjustably mounted on the beam between the first and second movable bearing members and carries a third movable bearing member, the device being applicable in particular for straightening out polyethylene tubes to be assembled end to end.

10 Claims, 4 Drawing Sheets

PORTABLE DEVICE FOR STRAIGHTENING OUT TUBES

BACKGROUND OF THE INVENTION

The present invention relates essentially to a portable device for straightening out tubes or pipes, in particular, tubes made from plastics material such for instance as high density polyethylene.

As known such tubes or pipes are used for the conveyance of various fluids such as gases but there are problems which are encountered in relation to the butt-and-butt junction of two pipes.

To do this, people were satisfied until now with putting two tube sections end to end which were connected by means of a for example electrically weldable sleeve coupling. However upon leaving the reel or winder the ends of the tube sections exhibit as is understandable a somewhat curved or bent end. Heretofore the bent or curved ends of two tube sections were connected together so that the assembly with a sleeve coupling could be difficult to be carried out owing to the necessarily imperfect alignment end to end and axial registering relationship of the ends of the tube sections to be assembled.

SUMMARY OF THE INVENTION

The object of the present invention is therefore to cope with this inconvenience in particular by providing a device for straightening out tubes or pipes of relatively great diameter and which would allow to remove the curvature or bend of the tubes at least for a time long enough to permit the butt-and-butt joining and the assembly end to end of these tubes according to a perfect axial alignment.

For that purpose the subject of the invention is a portable device for straightening out tubes in particular made from plastics material such as polyethylene for instance, of the type comprising a frame and at least three members for bearing upon the tube which are relatively movable with respect to the frame which they are made fast to, characterized in that the frame is a beam provided at its two ends with first and second movable bearing members, respectively, the first moveable bearing member being actuated by a jack or the like made fast to the beam whereas a grip for handling the device is mounted transversely on the beam between the first and second movable bearing members and carries a third movable bearing member.

According to another characterizing feature of this device the first movable bearing member operated by the jack consists of a link or the like pivotally connected with one end to the jack rod and with its other end carrying a roller or the like to a tie-rod itself pivotally connected to the beam.

According to still another characterizing feature of the invention the second movable bearing member consists of an element adjustably and slidably mounted on the beam along a direction substantially orthogonal to its center line axis.

According to a preferred embodiment the aforesaid element is a clevis supporting a roller and which carries an endless screw screwed into a part made fast to one end of the beam in such a manner that upon being screwed the clevis may slide with respect to the beam along a direction at right angles to its center line axis.

According to still a further characterizing feature of the invention the aforesaid handling grip exhibits a substantially U-like shape the legs of which are adjustably mounted on guides provided on the beam.

It should be specified here that the grip or handle is made fast to the middle portion of the beam and the base of the U formation constituting this grip or handle comprises a roller whereas the top of the U-shaped portion of the grip comprises a cross-member connecting both legs of the U-shaped portion.

It should further be specified here that on the beam are provided reinforcing brackets or gussets at the location of the fastening of the grip or handle to the said beam.

According to still another characterizing feature of the invention, a box, casing or like housing for operating the aforesaid jack is made fast to the beam and this control box advantageously exhibits the shape of a grip or handle.

The beam according to a preferred embodiment is a hollow beam in which is housed or accommodated the aforesaid jack the body of which is fastened to the aforesaid second movable bearing member.

According to still another characterizing feature of the device of this invention the rollers or the like made fast to the three movable bearing members, respectively, may be rotated by a motor allowing the automatic feed or advance of the hollow beam on the tube to be straightened out.

BRIEF DESCRIPTION OF THE DRAWINGS

The invention will be better understood and further objects, characterizing features, details and advantages thereof will appear more clearly as the following explanatory description proceeds with reference to the accompanying diagrammatic drawings given by way of non limiting examples only illustrating several presently preferred specific embodiments of the invention and wherein.

DETAILED DESCRIPTION OF THE PREFERRED EMBODIMENTS

Figure 1:
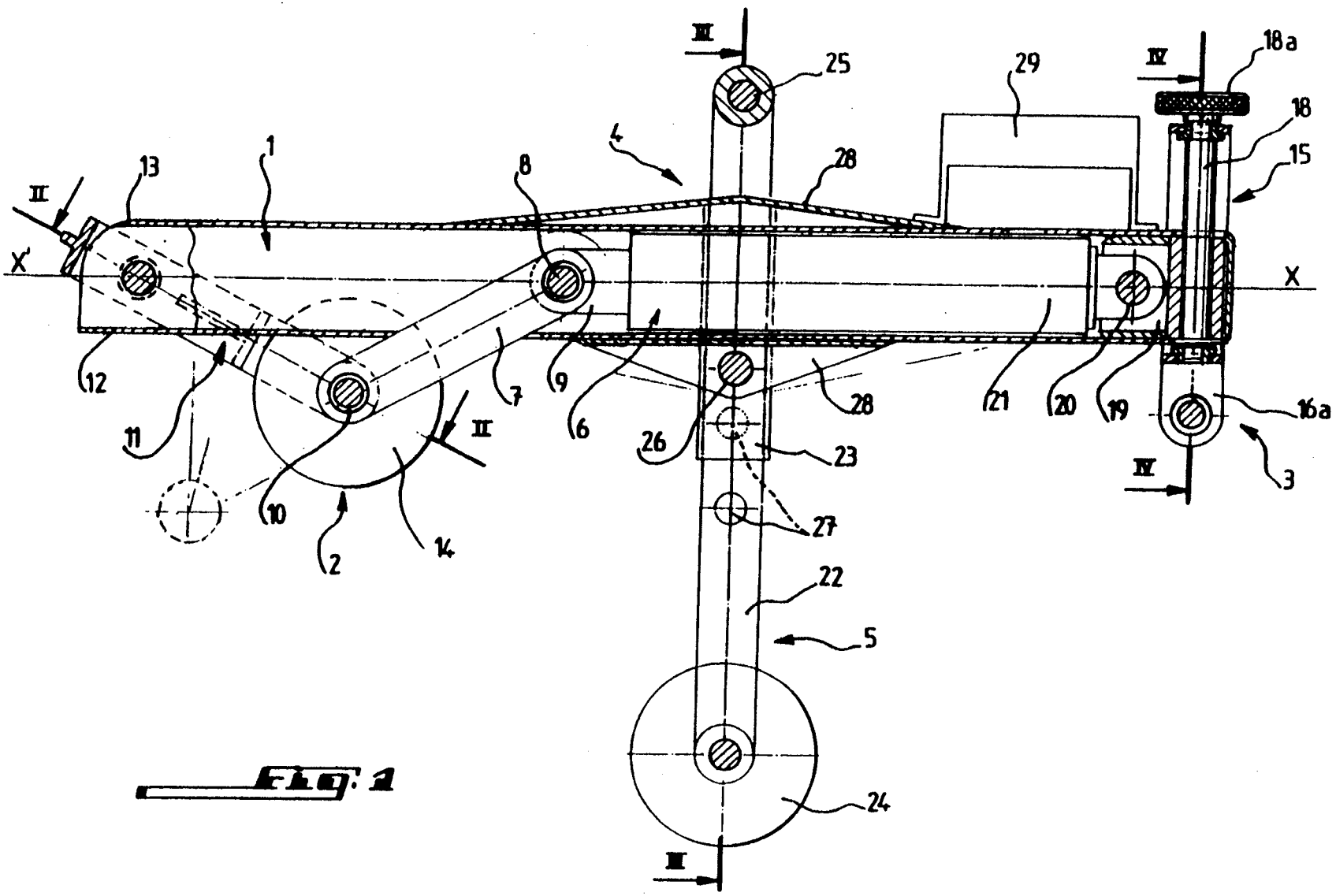
FIG. 1 is a diagrammatic side view of the device with a section taken upon the center line axis of the beam.

Referring in particular to FIG. 1 the portable device for straightening out tubes or pipes according to the principles of the invention essentially comprises a hollow beam 1 one of the ends of which carries a first movable bearing member 2 and the opposite end of which carries a second movable bearing member 3 whereas a grip 4 for handling this device is mounted transversely on the beam 1 between both movable bearing members 2 and 3.

The handling grip 4 is made fast to the middle portion of the hollow beam 1 and carries a third movable member 5.

The first movable bearing member 2 is actuated by a jack 6 housed or accommodated inside of the hollow beam 1 as well seen on FIG. 1 and this jack may be a hydraulic, pneumatic, electrical or even mechanical jack.

More specifically the first movably bearing member 2 consists of a link 7 extending through an opening of the hollow beam and pivotally connected with one end 8 to the rod 9 of the jack 6 whereas the other end 10 of the link 7 is pivotally connected to a tie-rod 11 itself pivotally connected at 12 to one preferably solid end 13 of the hollow beam 1.

Figure 2:
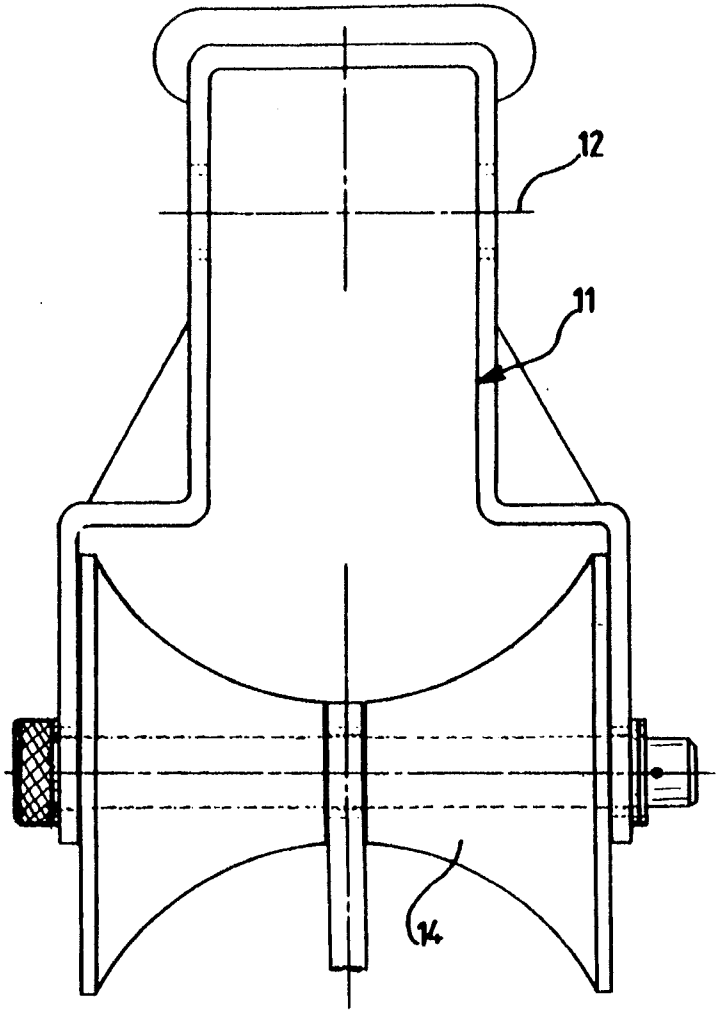
FIG. 2 is a sectional view taken upon the line II—II of FIG. 1.

More specifically the tie rod 11 as well seen on FIG. 2 exhibits the shape of a clevis or yoke between the legs of which is mounted a roller 14 carried in a way by the point 10 of pivotal connection of the link 7 to the tie rod or clevis or yoke 11.

It is thus understood from the foregoing that the operation of the rod 9 of the jack 6 will cause the roller 14 to be displaced as shown in dotted lines on FIG. 1.

Figure 4:
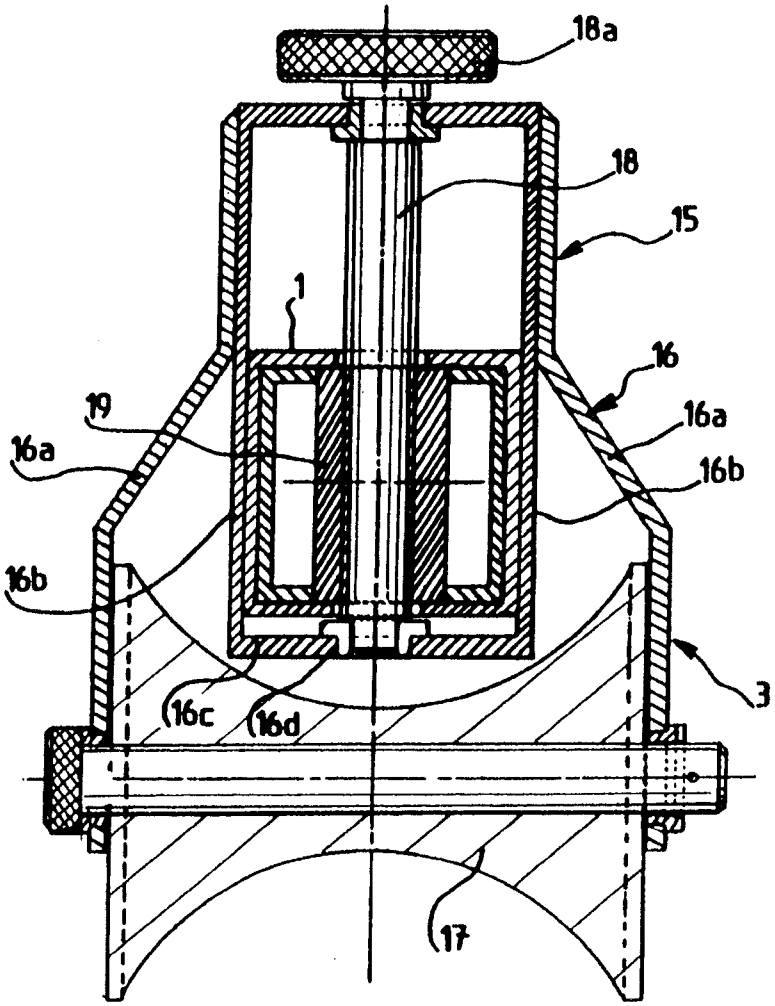
FIG. 4 is a sectional view taken upon the line IV—IV of FIG. 1.

The second movable bearing member 3 well visible on the right-hand portion of FIG. 1 and also on FIG. 4 consists essentially of an element 15 adjustably and slidably mounted at one of the ends of the hollow beam 1 along a direction which preferably is orthogonal to the centre line axis X—X' of the said hollow beam.

According to a preferred embodiment and as well seen on FIG. 4 the element 15 consists of a clevis 16 which carries a roller 17 mounted loose for idle or free rotation between the legs of the clevis.

The clevis 16 supports at its upper portion an endless screw 18 operable with a knob **18*a* and screwed into a part 19 susceptible of being fitted endwise of the hollow beam 1 as well seen on FIG. 1. On this Figure there is seen that the part 19 is keyed or cottered by a pin 20 onto the rear portion of the body 21 of the jack 6**.

It is thus understandable from the foregoing that upon performing the screwing or the unscrewing of the screw 18, the clevis or yoke 16 may slide in either direction with respect to the hollow beam 1 and this in a direction orthogonal to the center line axis X—X' of this beam. It should be pointed out here that the clevis 16 comprises two legs **16*a* carrying at their ends the roller 17 and is provided with two sub-legs 16*b* adapted to slide with respect to the hollow beam 1 and connected by a cross-member 16*c* forming a bearing 16*d* for the end of the endless screw 18**.

Figure 3:
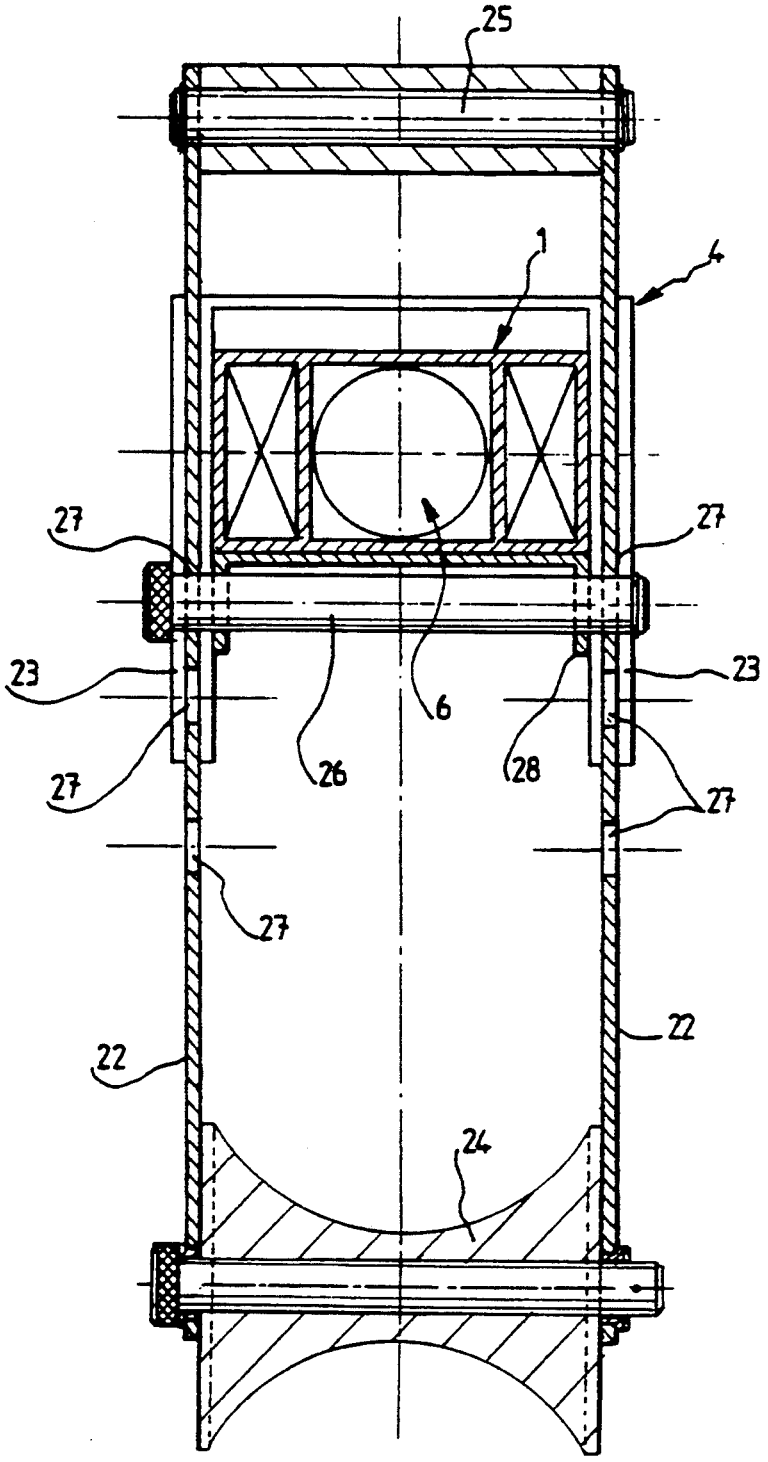
FIG. 3 is a sectional view of the grip for handling the device, taken upon the line III—III of FIG. 1.

As it appears clearly from FIGS. 1 and 3 the handling grip 4 of the device exhibits the general shape of a U the legs 22 of which are adjustably mounted on guides 23 made fast to the hollow beam 1 containing the jack 6.

The base of the U forming the handle 4 comprises a roller 24 of the same kind as the above-mentioned rollers 14 and 17 whereas the top of the U comprises a cross-member 25 connecting both legs 22 of the U and allowing to take hold or to grasp the device.

The legs 22 may be keyed onto the guides 23 by a pin or bolt 26 which may be inserted into staged confronting holes 27 formed in the legs 22 of the U. It is thus understandable that the fastening of the handling grip 4 onto the hollow beam 1 or yet the position of the roller 24 is adjustable in view of the three possible keying positions of the handle 4 on the hollow beam 1.

At 28 has been shown on FIGS. 1 and 3 reinforcing gussets or brackets made fast to the hollow beam 1 and located adjacent to the fastening of the handle 4 onto the beam 1, i.e. at the guides 23 and at the pin 26.

On FIG. 1 has been diagrammatically shown at 29 a control box or casing for the jack 6, this box or casing being secured onto the hollow beam 1 and advantageously exhibiting a handle-shaped configuration.

Figure 5:
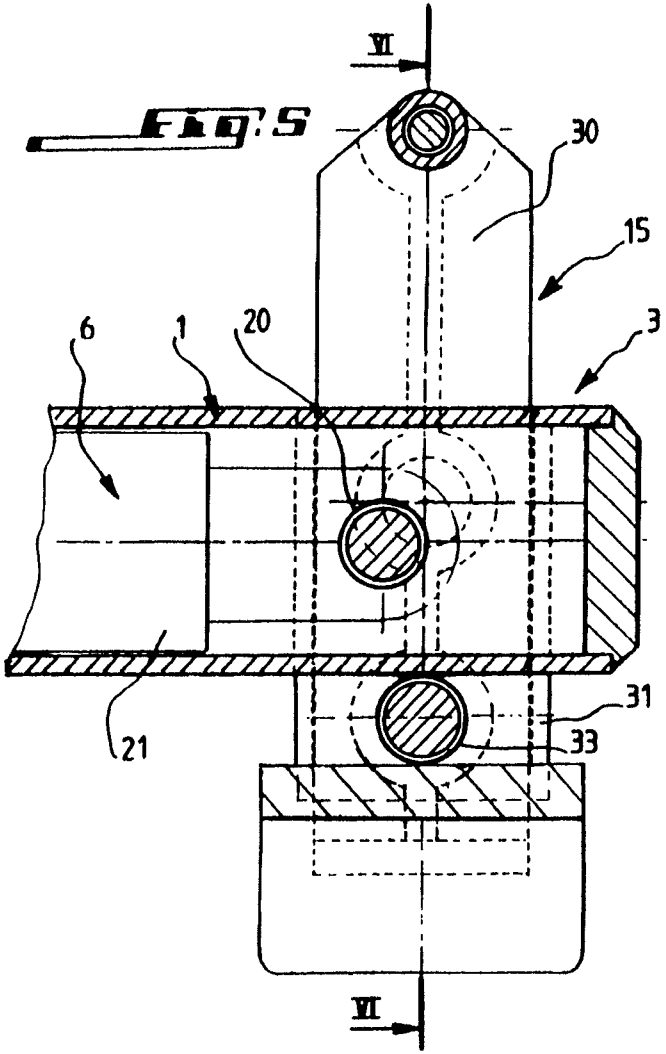
FIG. 5 is a sectional view of an alternative embodiment of the second movable bearing member mounted on one of the ends of the beam.

Referring now to FIG. 5, there is shown another embodiment of the second movable bearing member 3 which is more rudimentary than the one shown on FIGS. 1 and 4.

Figure 6:
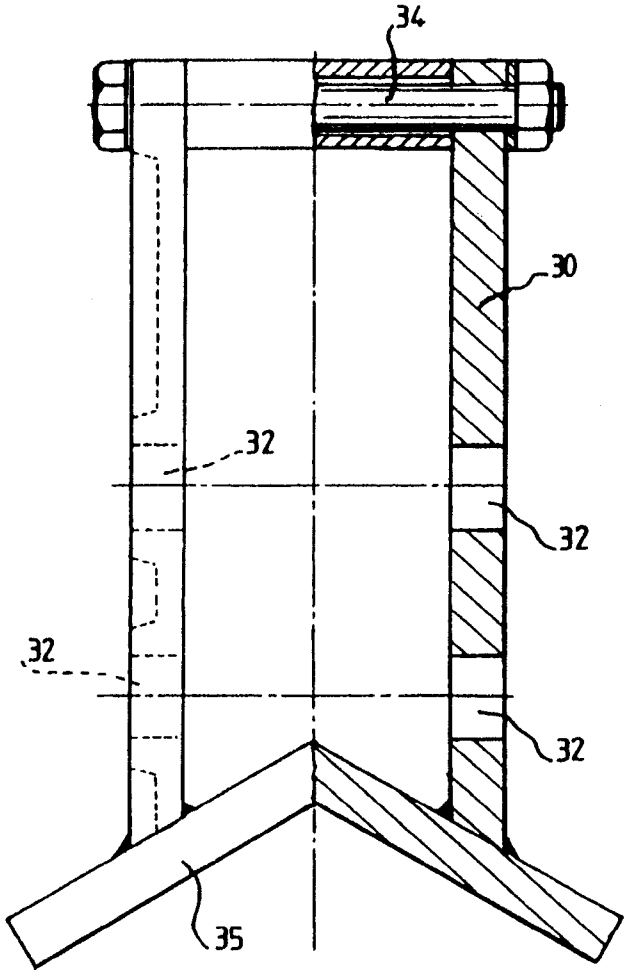
FIG. 6 is a sectional view of this second movable bearing member taken upon the line VI—VI of FIG. 5 and more specifically a half view in section and a half outside view of this member.

Here the element 15 as well seen on FIGS. 5 and 6 consists of a yoke 30 slidably mounted in a guide 31 made fast and orthogonal to the hollow beam 1. This yoke 30 comprises in its legs holes 32 in confronting and staged relationship allowing an adjustment of the yoke with respect to the hollow beam 1 by means of a pin 33. The yoke 30 may also be fastened to the body 21 of the jack 6 by a pin 20 as previously described.

The upper or top part of the yoke 30 is braced by a pin or bolt 34 whereas on its lower or bottom portion is welded a square-shaped part 35 adapted to bear upon the pipe to be straightened out.

In this respect it should be pointed out that such a bearing element could be provided without departing from the scope of the invention instead of the rollers 14 and 24 previously described.

It is however preferable that the three movable bearing members 2, 3, 5 be provided with rollers 14, 17 and 24, respectively, as previously described.

Although this has not been shown on the Figures these three rollers could be rotated or driven by a motor (not shown) allowing the automatic feed or advancing motion of the hollow beam 1 on the tube (not shown) to be straightened out.

Now for a better understanding of the invention it will be briefly explained hereinafter how the portable device of the present invention carries out the straightening process.

The curved or bent end of the pipe moving out from the reel or winder is interposed within the space formed between both rollers 14 and 17 and the roller 24 while having taken care to adjust in a suitable fashion, i.e. in accordance with the diameter of the pipe to be straightened out the position of the roller 24 by means of the pin or bolt 26.

Then the jack 6 should be operated which will control the motion of the roller 14 and a fine adjustment could be effected by acting upon the knob **18*a* for operating the roller 17**.

Consequently this therefore will remove the residual curvature or bend of the tube which will be perfectly straight and the characterizing features of which when the pipe is a tube of polyethylene for instance would leave a period long enough to allow a butt-and-butt joining and a perfect assembly of both pipes straightened out by the device.

It has therefore been provided according to the invention a simple, reliable and cheap portable device easily usable on building sites and which allows the removal or reversal of the curvature of the tubes in a quick and accurate manner to allow the assembly in butt-and-butt connecting relationship of these tubes by means of a for example electrically weldable sleeve or bush coupling.

The invention is of course not limited to the embodiments described and illustrated which have been given by way of example only.

Thus the members bearing upon the tube to be straightened out may have any suitable shape whatsoever as well as the jack associated with this device and the materials constituting the various elements or components of the device may also be of any kind whatsoever.

This means that the invention comprises all the technical equivalents of the means described as well as their combinations if the latter are carried out according to its gist and within the scope of the appended claims.

What is claimed is:

1. A portable device for straightening out tubes, said device comprising:

a beam having a first end and a second end;

a first bearing member pivotally mounted onto said first end of said beam and movable relative to said beam;

a second bearing member mounted onto said second end of said beam and movable in a transverse direction relative to a center line axis of said beam;

a third bearing member;

a handle transversely movably mounted onto said beam between said first and second ends, said handle having a top portion and a base portion, said base portion of said handle carrying said third bearing member, said top portion of said handle being located on said beam opposite said first, second and third bearing members, said first, second and third bearing members being arranged so as to allow a tube to be contacted on a first side by said first and second bearing members and to be contacted on a second side opposite to said first side by said third bearing member; and a jack fastened to said beam for actuating said first bearing member to be movable with respect to said beam, said jack controlling the motion of said first bearing member in removing the curvature of the tube while said second and third bearing members retain the tube, said jack comprising a rod movable in a direction parallel to said center line axis, said first bearing member comprising a roller which contacts the tube, a tie-rod and a link, said link having a first end pivotally connected with said rod of said jack and a second end opposite to said first end of said link being pivotally connected to a first end of said tie-rod at a pivot point, said tie-rod being pivotally connected to said beam at a second end of said tie-rod opposite to said first end of said tie-rod and carrying said roller at the pivot point at said first end of said tie-rod.

2. A device according to claim 1, wherein the second bearing member consists of an element adjustably and slidably mounted on the beam for motion in said transverse direction.

3. A device according to claim 2, wherein said element of said second bearing member is a clevis carrying a freely rotating roller which contacts the tube, said clevis supporting an endless screw screwed into said second end of said beam so that said clevis may slide in said transverse direction upon screwing or unscrewing said endless screw.

4. A device according to claim 1, wherein said handle is substantially U-shaped, and said base portion of said handle has legs, adjustably mounted on guides provided on said beam, which form sides of said U-shaped handle.

5. A device according to claim 4, wherein said U-shaped handle is fastened to a middle portion of said beam, said third bearing member comprises a roller arranged at ends of said legs, and a middle portion of said U-shaped handle comprises a cross-member for connecting said legs of said handle to one another and for mounting said legs of said handle onto said beam.

6. A device according to claim 1, wherein said beam is provided with reinforcing gussets for mounting said handle onto said beam.

7. A device according to claim 1, wherein comprising a box for controlling the actuation of said jack, said box being secured to said beam and being in the shape of a handle.

8. A device according to claim 1, wherein said beam is hollow, said jack is housed within said hollow beam, said jack has a portion fastened to said second bearing member and said link extends through an opening in said hollow beam.

9. A device according to claim 1, wherein each of said second and third bearing members comprises a roller which contacts the tube, said rollers of said first, second and third bearing members being rotatable by a motor effecting the automatic advancing motion of said beam onto a tube to be straightened out.

10. A portable device for straightening out tubes, comprising a hollow beam having a first end and a second end, a first bearing member pivotally mounted onto said first end of said beam and movable relative to said beam;

a second bearing member mounted onto said second end of said beam and movable in a transverse direction relative to a center line axis of said beam;

a third bearing member;

a handle transversely movably mounted onto said beam between said first and second bearing members, said handle having a top portion and a base portion, said base portion of said handle carrying said third bearing member, said top portion of said handle being located on said beam opposite said first, second and third bearing members, said first, second and third bearing members being arranged so as to allow a tube to be contacted on a first side by said first and second bearing members and to be contacted on a second side opposite to said first side by said third bearing member;

a jack fastened to said beam for actuating said first bearing member to be movable with respect to said beam, said jack controlling the motion of said first bearing member to remove curvatures in the tube while said second and third bearing members retain the tube, said jack being housed within said hollow beam and having a portion fastened to said second bearing member; and means extending through an opening in said hollow beam for mounting said jack to said first bearing member.

* * * * *